US005531491A

United States Patent [19]

Skelton

[11] Patent Number: 5,531,491

[45] Date of Patent: Jul. 2, 1996

[54] SECURITY DOOR LOCK

[76] Inventor: Wayne F. Skelton, 1431 Ocean Ave. #1011, Santa Monica, Calif. 90401

[21] Appl. No.: 393,355

[22] Filed: Feb. 23, 1995

[51] Int. Cl.[6] ..... E05C 19/18

[52] U.S. Cl. ..... 292/293; 292/291

[58] Field of Search ..... 292/291, 292, 292/258, 289, 288, 293, 294, 295, 340; 411/546

[56] References Cited

U.S. PATENT DOCUMENTS

| | | | |
|---|---|---|---|
| 605,809 | 6/1898 | Plimpton | 292/293 |
| 759,599 | 5/1904 | Ette | 411/546 |
| 951,766 | 3/1910 | Coffin | 411/546 |
| 1,073,238 | 9/1913 | Huston | 292/293 |
| 2,562,301 | 7/1951 | Dorion | 292/293 |
| 3,429,151 | 2/1969 | Weingart | 292/291 X |
| 3,854,764 | 12/1974 | Corrigan | 292/289 |

FOREIGN PATENT DOCUMENTS

| | | | |
|---|---|---|---|
| 575877 | 8/1924 | France | 292/293 |
| 622090 | 11/1935 | Germany | 292/258 |

*Primary Examiner*—Rodney M. Lindsey

[57] ABSTRACT

The present invention provides a new and improved portable door lock that can be used in conjunction with a door, a door jamb and a striker plate. The portable door lock comprises a bolt having a first end, a second end and an intermediate extent therebetween. A cylindrical threaded portion comprises the first end of the bolt. The cylindrical threaded portion has an outer diameter defined by the threads. A flat portion comprises the second end of the bolt. The flat portion has a width and a thickness which allows it to extend between a door and a door jamb. A hook portion extends from and is integral with the second end of the bolt. The hook has a top surface and a bottom surface. The hook is adapted to be engaged around the striker plate of a door jamb. A securing fitting is employed by the lock. The fitting has a hollow cylindrical first end and a first side and a second side, and a flat plate at the second end. The flat plate extends 90 degrees relative to, and at one side of, the cylindrical first end. The cylindrical first end has an internal diameter which is larger than the outer diameter of the threaded portion of the bolt. The metal securing fitting is positioned over the cylindrical threaded portion of the bolt. A wing nut is employed in securing the overall lock. The nut has two finger-engaging portions and an internal threaded aperture. The internal threaded aperture of the wing nut is adapted to be secured over the threaded cylindrical portion of the bolt.

1 Claim, 4 Drawing Sheets

SECURITY DOOR LOCK

BACKGROUND OF THE INVENTION

1. Field of the Invention

The present invention relates to a security door lock and more particularly pertains to a portable auxiliary door lock.

2. Description of the Prior Art

The use of portable door locks is known in the prior art. More specifically, portable door locks heretofore devised and utilized for the purpose of securing doors are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,280,977 to Piva an auxiliary door lock.

U.S. Pat. No. 5,195,791 to Hu discloses a portable security buckle for doors.

U.S. Pat. No. 5,088,780 to Doherty discloses a lockkeeper security shield plate.

U.S. Pat. No. 5,203,187 to Kane discloses a portable door lock closure.

Lastly, U.S. Pat. No. 4,285,535 to Leary discloses a portable auxiliary door lock.

In this respect, the security door lock according to the present invention substantially departs from the conventional concepts and designs of the prior art, and in doing so provides an apparatus primarily developed for the purpose of securing a door in a simple and secure manner.

Therefore, it can be appreciated that there exists a continuing need for a new and improved security door lock which can be used for securing a door in an easy and secure manner. In this regard, the present invention substantially fulfills this need.

SUMMARY OF THE INVENTION

In view of the foregoing disadvantages inherent in the known types of portable door locks now present in the prior art, the present invention provides an improved security door lock. As such, the general purpose of the present invention, which will be described subsequently in greater detail, is to provide a new and improved security door lock and method which has all the advantages of the prior art and none of the disadvantages.

To attain this, the present invention essentially comprises a portable lock including a bolt, a securement fitting, and a wing nut. The bolt is preferably constructed from a metal such as steel and is between 3 inches and 3¾ inches in length. The bolt has a first end, a second end and an intermediate extent therebetween. A cylindrical threaded portion comprises the first end of the bolt with the cylindrical threaded portion having an outer diameter defined by the threads. A flat portion comprises the second end of the bolt. The flat portion has a width and the length is approximately half the overall length of the bolt. The thickness of the flat portion is such as to allow it to extend between a door and a door jamb. The hook portion extends from and is integral with the second end of the bolt. The hook has a top surface and a bottom surface. Furthermore, the hook extends from the flat portion at an angle from between greater than 90 degrees and less than 180 degrees. The hook has a width which is larger than the width of the flat portion. The increased width of the hook facilitates its engagement around the striker plate of the door jamb. The securing fitting like the bolt is preferably constructed from a metal such as steel. The fitting has a hollow cylindrical first end comprising a first side and a second side, and a flat plate at the second end. The flat plate extends 90 degrees relative to, and at one side of, the cylindrical first end. Furthermore, the cylindrical first end has an internal diameter which is larger than the outer diameter of the threaded portion of the metal bolt. This allows the fitting to slide over the threaded cylindrical portion of the bolt. The side of the cylindrical first end opposite the flat plate is tapered from the end of the fitting towards its first end. In use, the metal securing fitting is positioned over the cylindrical threaded portion of the bolt.

In order to provide extra strength to the overall lock, and more security in its use, strengthening flanges are employed between the flat plate and the hollow cylindrical end of the fitting. These strengthening flanges are machined integral with the fitting, and as such are preferably constructed from a metal such as steel. The three strengthening flanges are equidistantly spaced from one another, with each of the strengthening flanges being integral with and connected between the flat plate and the hollow cylindrical first end of the metal securing fitting.

As previously described, a wing nut is employed in securing all the components of the lock together. The wing nut has two finger-engaging portions and an internal threaded aperture. The internal threaded aperture of the wing nut is adapted to be secured over the threaded cylindrical portion of the metal bolt.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved security door lock which have all the advantages of the prior art portable door locks and none of the disadvantages.

It is another object of the present invention to provide a new and improved security door lock which may be easily and efficiently manufactured and marketed.

It is a further object of the present invention to provide a new and improved security door lock which is of durable and reliable constructions.

An even further object of the present invention is to provide a new and improved security door lock which is susceptible of a low cost of manufacture with regard to both materials and labor, and which accordingly is then susceptible of low prices of sale to the consuming public, thereby making such security door lock economically available to the buying public.

Still yet another object of the present invention is to provide a new and improved security door lock which provides in the apparatuses and methods of the prior art some of the advantages thereof, while simultaneously overcoming some of the disadvantages normally associated therewith.

Even still another object of the present invention is to provide a portable door lock with extra strengthening flanges.

Lastly, it is an object of the present invention to provide a new and improved portable door lock that can be used in conjunction with a door, a door jamb and a striker plate. The portable door lock comprises a bolt having a first end, a second end and an intermediate extent therebetween. A cylindrical threaded portion comprises the first end of the bolt. The cylindrical threaded portion has an outer diameter defined by the threads. A flat portion comprises the second end of the bolt. The flat portion has a width and a thickness which allows it to extend between a door and a door jamb. A hook portion extends from and is integral with the second end of the bolt. The hook has a top surface and a bottom surface. The hook is adapted to be engaged around the striker plate of a door jamb. A securing fitting is employed by the lock. The fitting has a hollow cylindrical first end and a first side and a second side, and a flat plate at the second end. The flat plate extends 90 degrees relative to, and at one side of, the cylindrical first end. The cylindrical first end has an internal diameter which is larger than the outer diameter of the threaded portion of the bolt. The metal securing fitting is positioned over the cylindrical threaded portion of the bolt. A wing nut is employed in securing the overall lock. The nut has two finger-engaging portions and an internal threaded aperture. The internal threaded aperture of the wing nut is adapted to be secured over the threaded cylindrical portion of the bolt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
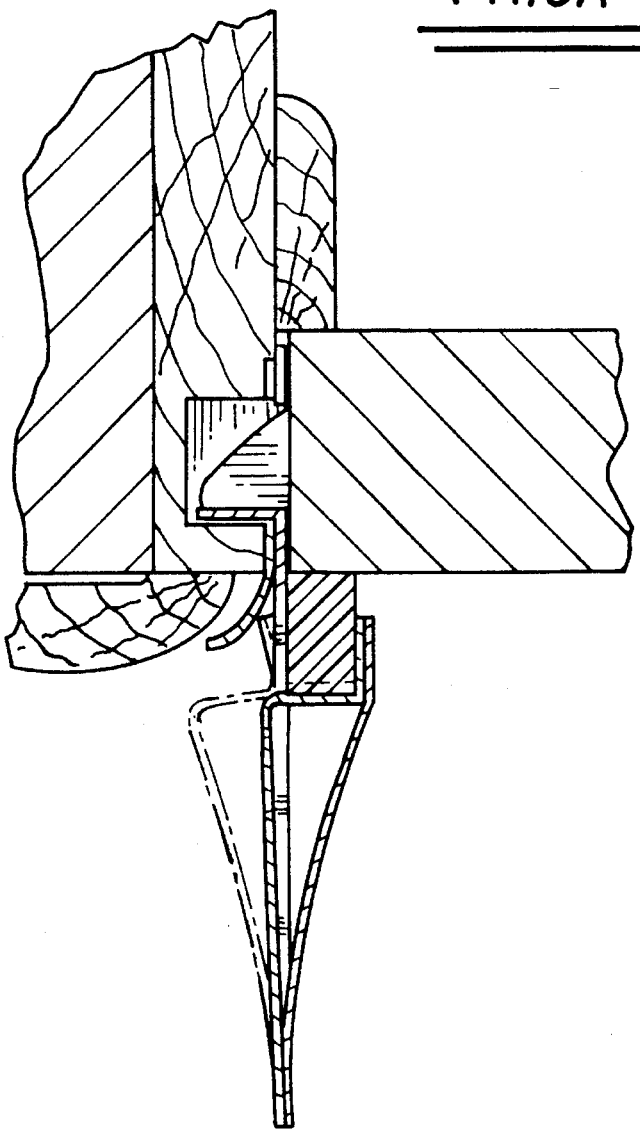
FIG. 1 PRIOR ART
FIG. 1 is a sectional view of a prior art lock.
Figure 2:
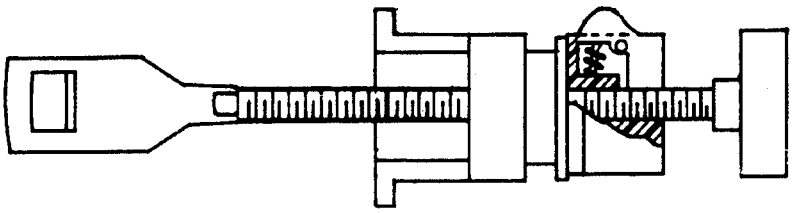
FIG. 2 PRIOR ART
FIG. 2 is a view of a prior art lock.
Figure 3:
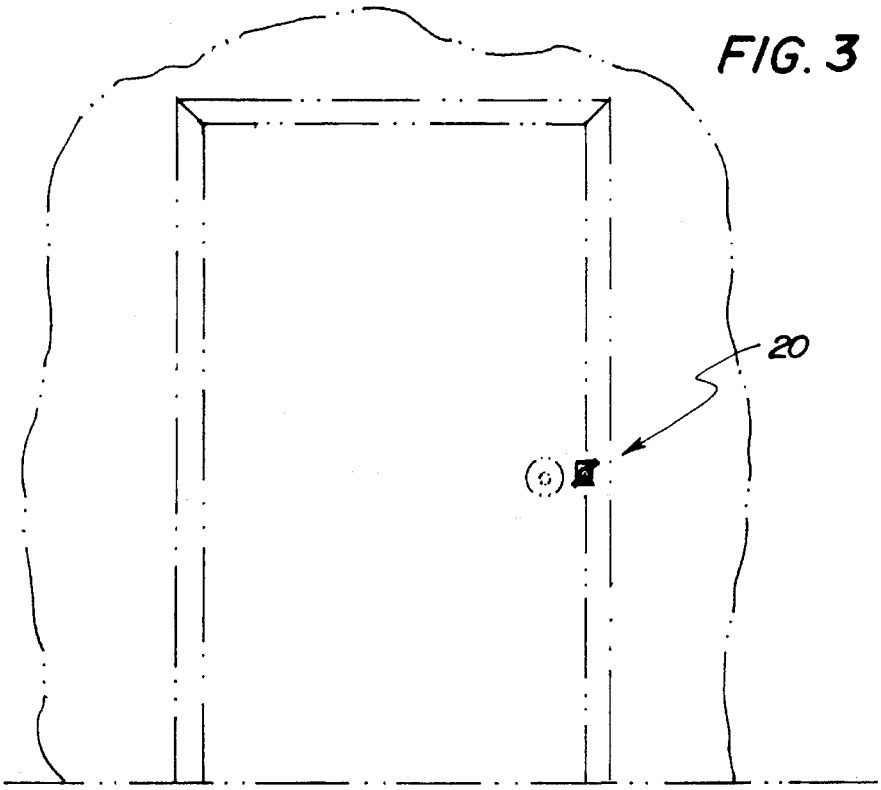
FIG. 3 is a view of lock of the present invention in use on a door.
Figure 4:
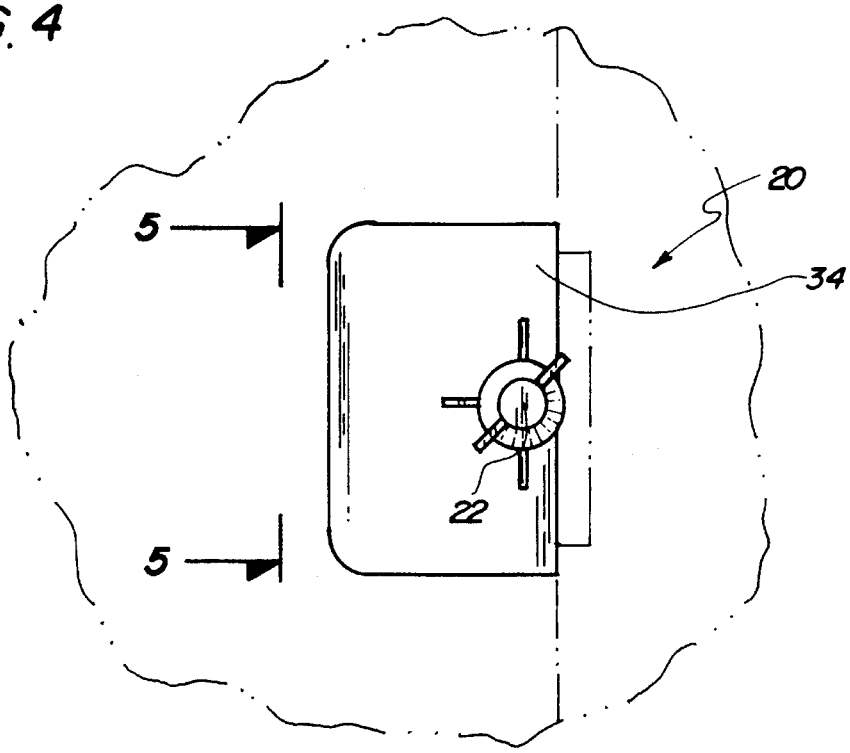
FIG. 4 is a view of the lock of the present invention in use on a door.
Figure 5:
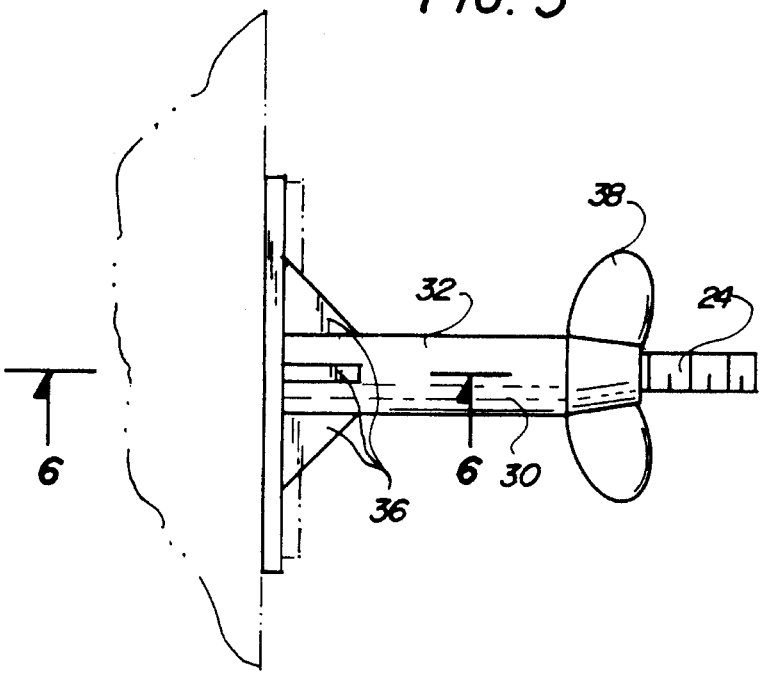
FIG. 5 is a view taken along line 5—5 of FIG. 4.
Figure 6:
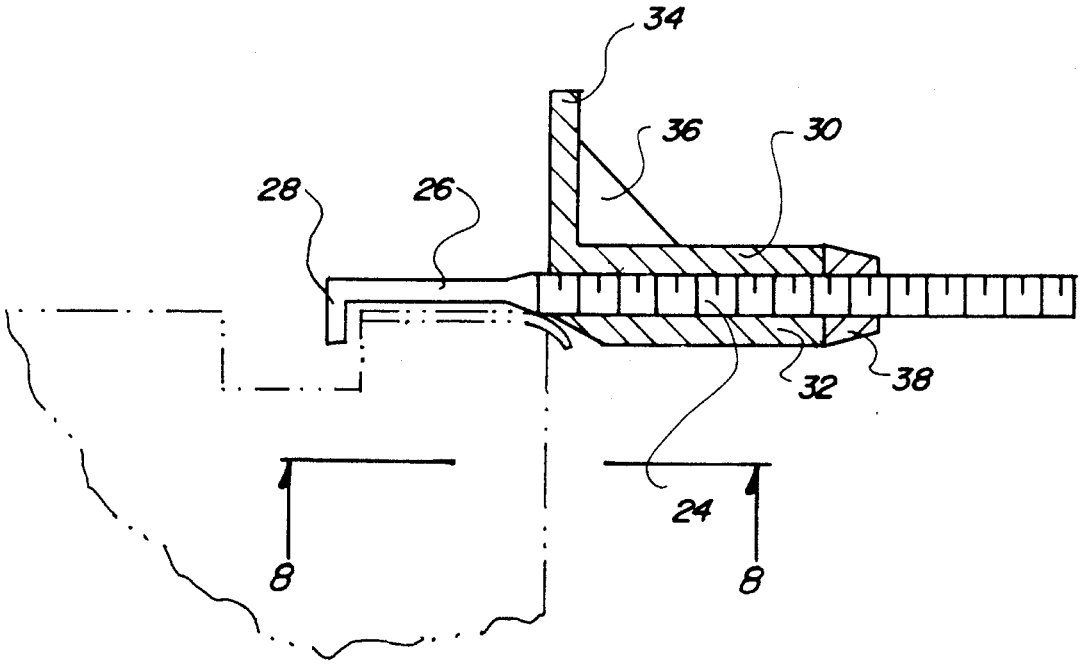
FIG. 6 is a view taken along 6—6 of FIG. 5.
Figure 7:
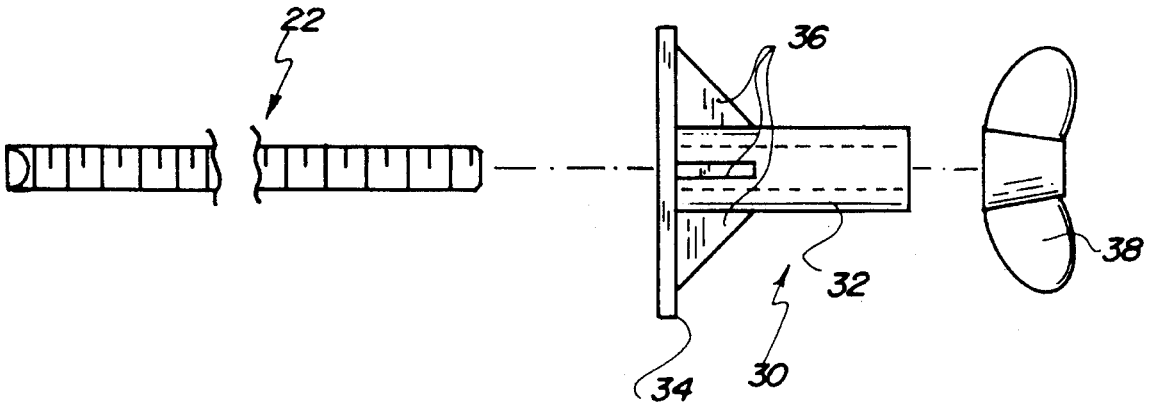
FIG. 7 is an exploded view of the lock in accordance with the present invention.
Figure 8:
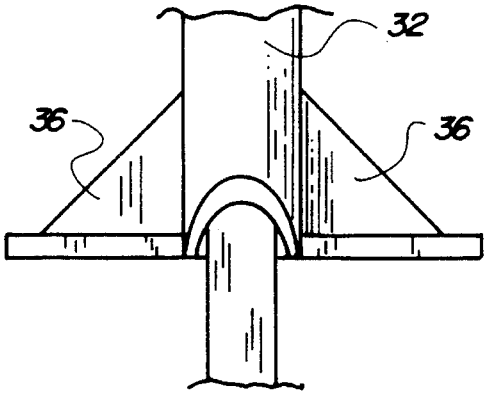
FIG. 8 is a view of the tapered portion of the securement fitting of the lock of the present invention.

With reference now to the drawings, and in particular to FIG. 3 thereof, the preferred embodiment of the new and improved security door lock embodying the principles and concepts of the present invention and generally designated by the reference numeral 10 will be described.

The present invention relates to a portable, auxiliary door lock. In its broadest context, the present invention includes a bolt having a flat portion with a hook, and a threaded portion, a securement fitting adapted to fit over the threaded portion of the bolt, and a wing nut adapted to be engaged with the threaded portion of the bolt. In use, the hook of the flat portion of the bolt is engaged about the striker plate of the door jamb, with the flat portion of the bolt positioned between the door and the door jamb. The securement fitting is then positioned over the bolt. The securement fitting includes a flat portion which is adapted to engage the door. The wing nut is employed in keeping pressure on the securement fitting. Thus, if an intruder attempts to gain entry, the hook, the flat portion of the securement fitting, and the wing nut prevent the door from opening. All the various components of the present invention will now be described in greater detail.

The bolt 22 is preferably constructed from a metal such as steel and is between 3 inches and 3 ¾ inches in length. The bolt 22 has a first end, a second end and an intermediate extent therebetween. A cylindrical threaded portion 24 comprises the first end of the bolt 22 with the cylindrical threaded portion 24 having an outer diameter defined by the threads. A flat portion 26 comprises the second end of the bolt 22. The flat portion 26 has a width and the length is approximately half the overall length of the bolt 22. The thickness of the flat portion 26 is such as to allow it to extend between a door and a door jamb. The hook 28 portion extends from and is integral with the second end of the bolt 22. The hook 28 has a top surface and a bottom surface. Furthermore, the hook 28 extends from the flat portion 26 at an angle from between greater than 90 degrees and less than 180 degrees. The hook 28 has a width which is larger than the width of the flat portion 26. The increased width of the hook 28 facilitates its engagement around the striker plate of the door jamb.

The securing fitting 30 like the bolt 22 is preferably constructed from a metal such as steel. The fitting 30 has a hollow cylindrical first end 32 comprising a first side and a second side, and a flat plate 34 at the second end. The flat plate 34 extends 90 degrees relative to, and at one side of, the cylindrical first end. Furthermore, the cylindrical first end has an internal diameter which is larger than the outer diameter of the threaded portion of the metal bolt 22. This allows the fitting 30 to slide over the threaded cylindrical portion of the bolt 22. The side of the cylindrical first end opposite the flat plate 34 is tapered from the end of the fitting 30 towards its first end. In use, the metal securing fitting 30 is positioned over the cylindrical threaded portion 24 of the bolt 22.

In order to provide extra strength to the overall lock 20, and more security in its use, strengthening flanges 36 are employed between the flat plate 34 and the hollow cylindrical end of the fitting 30. These strengthening flanges 36 are machined integral with the fitting 30, and as such are preferably constructed from a metal such as steel. The three strengthening flanges 36 are equidistantly spaced from one another, with each of the strengthening flanges being integral with and connected between the flat plate 34 and the hollow cylindrical first end of the metal securing fitting As previously described, a wing nut 38 is employed in securing all the components of the lock 20 together. The wing nut 38 has two finger engaging portions and an internal threaded aperture. The internal threaded aperture of the wing nut 38 is adapted to be secured over the threaded cylindrical portion of the metal bolt 22.

Thus what has been described is a device that provides an added security lock for a door that helps prevent the door from being forced open from the outside. The device is made of metal and consists of a bolt with a threaded length on one end and a flattened length on the other, a sleeve with a faceplate on one end, and a wing nut. The bolt is approximately 3-¾ inches long, with approximately half its length being threaded, and the other half flattened with a hook on its end. The one-piece cylindrical sleeve and faceplate, which fits over the bolt when assembled to secure a door, is approximately 2 inches long and has a approximately ¾ inch outside diameter and an inside diameter that slips over the threaded end of the bolt. A 2 inch high by ⅞ inch wide faceplate is positioned perpendicular to the sleeve's axis at one end. The inner diameter hole through the sleeve continues through the faceplate. With the door open, the flattened end of the bolt is slid between the door and its jamb, the hook is fastened over the striker plate, and then the door is closed. The collar is placed over the bolt with its faceplate flush up against the door. The device is secured by putting the wing nut onto the bolt and tightening it. The lock is small and is easily carried in one's purse or suitcase. It is easy to install and fits on doors of varying thicknesses. In addition, it provides added security and peace of mind.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable door lock that can be used in conjunction with a door, door jamb and striker plate, the portable door lock comprising in combination:

a metal bolt between 3" and 3 ¾" in length having a first end, a second end and an intermediate extent therebetween, a cylindrical threaded portion comprising the first end of the bolt, the cylindrical threaded portion having an outer diameter defined by the threaded portion, a flat portion comprising the second end of the bolt, the flat portion having a width, the flat portion being approximately half the length of the bolt, the flat portion having a thickness which allows it to extend between a door and a door jamb, a hook portion extending from and integral with the second end of the bolt, the hook portion having a top surface and a bottom surface, the hook portion extending from the flat portion at an angle from between greater than 90 degrees and less than 180 degrees, the hook portion having a width which is larger than the width of the flat portion, the hook portion adapted to be engaged around the striker plate of the door jamb;

a metal securing fitting having a hollow cylindrical first end having a first side and a second side, and a flat plate at a second end, the flat plate extending 90 degrees relative to, and at one side of, the cylindrical first end, the cylindrical first end having an internal diameter which is larger than the outer diameter of the threaded portion of the metal bolt, the side of the cylindrical first end opposite the flat plate being tapered from the second towards the first end to allow for the positioning of the striker plate, the metal securing fitting positioned over the cylindrical threaded portion of the bolt;

three strengthing flanges, equidistantly spaced from one another, each of the strengthing flanges being integral with and connected between the flat plate and the hollow cylindrical first end of the metal securing fitting, the strengthing flanges allowing the door lock to withstand greater amounts of applied force;

a wing nut having two finger engaging portions and an internal threaded aperture, the internal threaded aperture of the wing nut adapted to be secured over the threaded cylindrical portion of the metal bolt.

* * * * *